US010702755B2

(12) United States Patent
Sams, III et al.

(10) Patent No.: US 10,702,755 B2
(45) Date of Patent: Jul. 7, 2020

(54) BALL MOUNTING SYSTEM, LED CABLE AND TIP PROTECTOR FOR AN IMPROVED SWING TRAINING DEVICE

(71) Applicants: James I. Sams, III, Venetia, PA (US); Michael J. Homer, Coraopolis, PA (US); Paul R. Chalifoux, Naples, FL (US)

(72) Inventors: James I. Sams, III, Venetia, PA (US); Michael J. Homer, Coraopolis, PA (US); Paul R. Chalifoux, Naples, FL (US)

( * ) Notice: Subject to any disclaimer, the term of this patent is extended or adjusted under 35 U.S.C. 154(b) by 0 days.

(21) Appl. No.: 16/383,324

(22) Filed: Apr. 12, 2019

(65) Prior Publication Data

US 2019/0314700 A1 Oct. 17, 2019

Related U.S. Application Data

(60) Provisional application No. 62/657,669, filed on Apr. 13, 2018.

(51) Int. Cl.
*A63B 69/00* (2006.01)
*A63B 71/06* (2006.01)

(52) U.S. Cl.
CPC ..... *A63B 69/0002* (2013.01); *A63B 69/0084* (2013.01); *A63B 71/0622* (2013.01); *A63B 2069/0008* (2013.01); *A63B 2071/0647* (2013.01); *A63B 2207/02* (2013.01); *A63B 2220/40* (2013.01); *A63B 2220/62* (2013.01); *A63B 2220/803* (2013.01); *A63B 2220/833* (2013.01); *A63B 2225/50* (2013.01)

(58) Field of Classification Search
CPC ..... A63B 69/0084; A63B 2069/0008; A63B 69/0073–0091; F21V 15/013
USPC ..... 473/426
See application file for complete search history.

(56) References Cited

U.S. PATENT DOCUMENTS

| | | | | |
|---|---|---|---|---|
| 5,036,442 | A * | 7/1991 | Brown | A63B 15/00 362/102 |
| 7,300,388 | B2 * | 11/2007 | Sams, III | A63B 69/0002 482/89 |
| 9,039,548 | B2 * | 5/2015 | Sams, III | A63B 69/0002 473/426 |
| 9,623,308 | B2 * | 4/2017 | Bourgeois | A63B 69/0002 |
| 2006/0035730 | A1 * | 2/2006 | Nguyen | A63B 69/0073 473/417 |
| 2013/0172129 | A1 * | 7/2013 | Sams, III | A63B 69/0002 473/417 |
| 2016/0082339 | A1 * | 3/2016 | Van Dyke | A63B 69/0046 473/55 |

* cited by examiner

*Primary Examiner* — Melba Bumgarner
*Assistant Examiner* — Laura Davison
(74) *Attorney, Agent, or Firm* — Gary P. Topolosky

(57) ABSTRACT

A new and improved training swing training device includes: (a) a deflector tube at a forward most end of its LED cable system; (b) an improved cable system sheathed in a transparent, more damage-resistant tubing; and (c) a new ball mounting system that employs an O-ring configuration for slidably engaging along the aforementioned cable system tubing with each successful contact swing with its tethered baseball (or softball).

13 Claims, 6 Drawing Sheets

BALL MOUNTING SYSTEM, LED CABLE AND TIP PROTECTOR FOR AN IMPROVED SWING TRAINING DEVICE

RELATED APPLICATION

This application is a perfection of U.S. Provisional Application Ser. No. 62/657,669 filed on Apr. 13, 2018, the disclosure of which is fully incorporated herein.

FIELD OF THE INVENTIONS

This application addresses several improvements to the devices of both Sams U.S. Pat. No. 7,300,388 and Sams U.S. Pat. No. 9,039,548, both disclosures of which are fully incorporated herein. The new units are intended to be made and sold under the proposed product name: SwingNOW™.

The present disclosure is directed to further improvements to a device for developing and training the proper swing mechanics of a baseball or softball player using a visual cue to as part of a system initiate a more timely swing of his/her bat at a duly mounted practice ball. The system is designed to record the timeliness of the swing using motion sensors to record contact with the ball. The system provides feedback to the player using a computer and a visual display means.

SUMMARY OF THE INVENTIONS

There are at least three inventions represented by this disclosure, all relating to improvements over the devices of U.S. Pat. Nos. 7,300,388 and 9,039,548. They pertain to a better ball mount assembly for the previous devices and a better system for protecting the LED cable line critical to the aforementioned, earlier devices. While the accompanying drawings include particular dimensions and materials choices, they are merely representative of the currently preferred embodiments of these improvements. It is to be understood that still other dimensions of, and materials for particular components may be supplemented by or substituted for in the ultimate production assembly versions of this latest improved swing training device.

Like its predecessor systems, this latest device is intended to help batters develop better eye movement and tracking skills to strike or hit a simulated moving object. It will provide a more realistic practice experience to users of swing trainers in a manner that simulates those skills used to hit a pitched baseball or softball by conditioning the eyes to track and time a moving light source. These inventions still provide a cue for hitters to consistently swing a bat on time. These improvements better protect the LED cable of earlier systems and provide an improved ball mount connection system to that LED cable, both at its front end and by slidably engaging with the linear body of that cable casing.

BACKGROUND FOR THESE INVENTIONS

A sports training device is used to teach specific skills required for a sport. The device may be used to fine tune and exercise the muscular-skeletal mechanics related to the specific sport. The device may be used to practice and drill specific skills on and off the playing field. At competitions, the device may be used for pre-game warm-up exercises. Training devices generally include mobile or stationary objects used in the specific sport. In baseball or softball, for instance, a training device may include a mobile or stationary baseball, softball or similar object that a user may strike with his or her baseball/softball bat.

To enhance the training device, the earlier versions of this disclosure proposed a light-driven timing mechanism to train and develop the hand and eye skills used to track and time a moving object such as a baseball or softball. These latest developments further protect the earlier devices from unintentional damage to respective components while enabling greater longevity of the assembled systems thereby.

This new and improved training device now includes: (a) a deflector tube at a forward most end of its LED cable system; (b) an improved cable system sheathed in a transparent, more damage-resistant tubing; and (c) a new ball mounting system that employs an O-ring configuration for slidably engaging along the aforementioned cable system tubing with each successful contact swing with its tethered baseball (or softball).

BRIEF SUMMARY OF THE DRAWINGS

Further features, objectives and advantages of this invention will become clearer with the following description made with reference to the drawings in which.

DESCRIPTION OF PREFERRED EMBODIMENTS

Figure 1A:
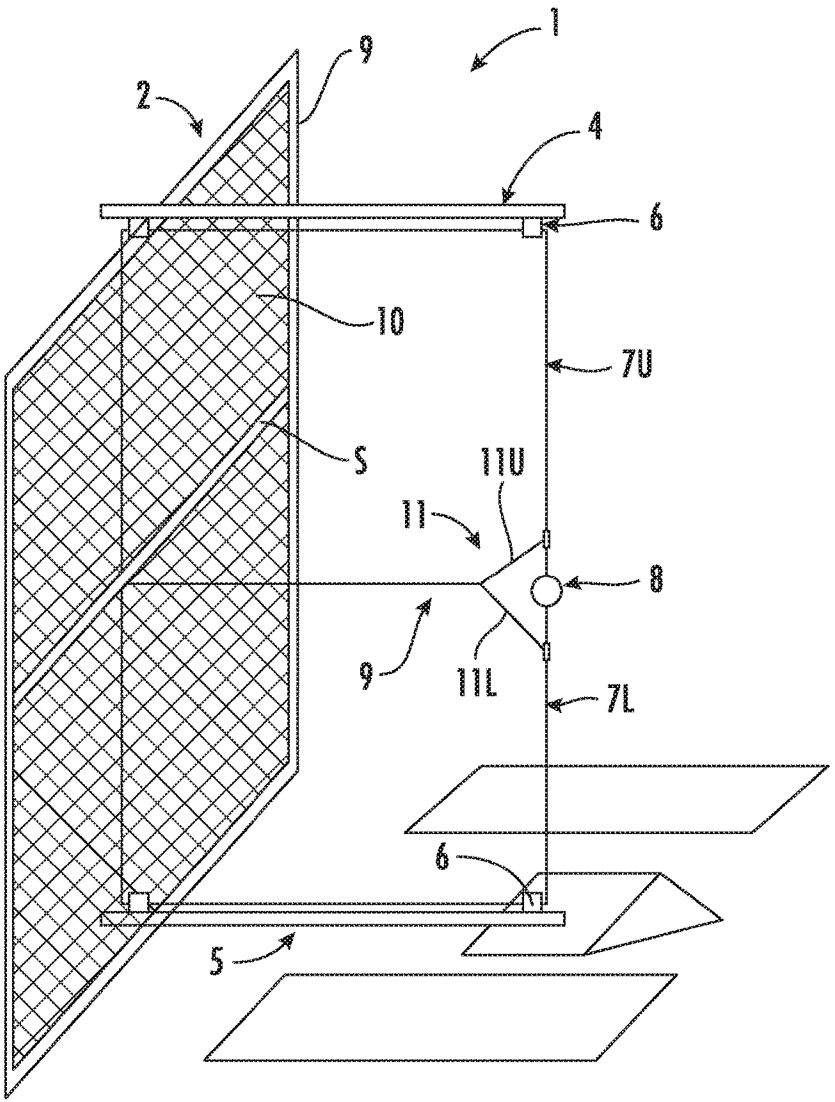
FIG. 1A PRIOR ART
FIG. 1A—PRIOR ART is a perspective view of applicant's earlier swing training device positioned over a simulated home plate area of a baseball playing field (or practice area)

As described in Sams' two earlier patents, the background for the improved swing training device of this invention is shown in PRIOR ART FIG. 1A. The device, generally 1, comprises a background frame 2 (with netting 10) through which a pair of connector swing arms perpendicularly extending in a substantially horizontal manner. More particularly, there is an upper arm 4 and a lower arm 5 both of which contain pulley wheels 6 through which a stretch cord 7 freely moves. A practice-hitting ball 8 (either a baseball or a softball) operatively couples to a central support S of frame 2 via lighted line 9. More particularly, ball 8 has an upper stretch cord 7U and a lower cord 7L. A V-line configuration, generally 11, with its upper arm 11U and lower arm 11L, serve as the actual connectors of ball 8 to line 9. That V-line, as disclosed and claimed in U.S. Pat. No. 7,300,388, serves two purposes: (i) first, to control and stabilize ball 8 after contact with a swinging bat during practice; and (ii) secondly, to provide some visual conditioning mechanism for training the user (i.e., batter) to track the flight of a simulated pitched ball with every practice swing by moving his/her eyes along lighted line 9. That invention, with its moving light source traversing lighted line 9 made the batter's swing training experience more realistic by simulating the trajectory of a moving object like a baseball or softball.

In the 2012 patent, that swing-training device tracked and timed a simulated moving ball using a sequence of LED lights along lighted line 9 to ball 8. Those lights (not shown in FIG. 1A) were operatively coupled to and controlled by a computing device so that light speeds could be varied to simulate different pitched ball speeds. It was understood that the user/batter would swing his/her bat and make contact with ball 8 when the sequenced LED lights terminated at the ball. A motion or sound sensor may have been added to record the time when bat-to-ball contact was made. The results of the swing could be displayed on a small computing device, and swing data wirelessly transmitted to external computing devices.

Figure 1B:
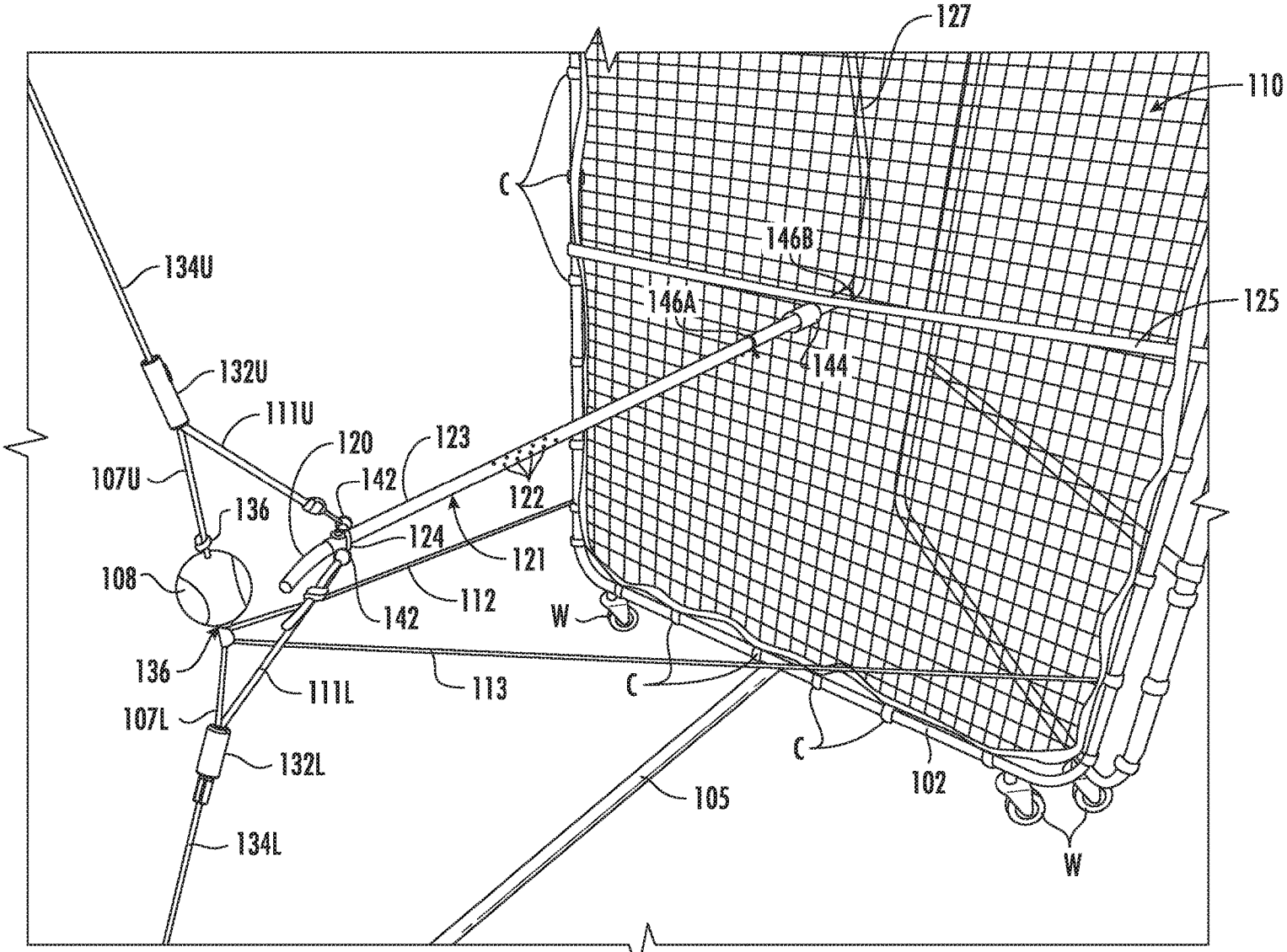
FIG. 1B is a front perspective view of this latest embodiment of swing training device focusing on the main improvements of a front deflector tube, an LED cable system and a sliding ring connection for the new batting ball mount.

In the latest set of device improvements, common elements are commonly numbered with the prior art system of FIG. 1A, though in the next hundred series. As such, FIG. 1B shows a frame 102 with its lower arm 105 being visible in this view. A section of netting 110 (shown as rectangular) affixes to frame 102. And the ball 108 (either a baseball, as shown, or a regulation-sized softball alternative) connects at the top and bottom via upper 107U and lower 107L ball line cords, which are, in turn, connected to bungee-like elastic frame cords 134U and L. Upper and lower ball line cords 107U and L also connect to their respective upper 111U and lower 111L V-line arms.

New to this device, there is also included a pair of diagonally extending, ball line support straps 112, 113 that affix at one end to the lower stretch cord 107L, just below ball 108, and at their opposite ends to frame 102 for better overall stabilization. It is to be understood that while one preferred embodiment operatively couples to a regulation size baseball 108, an alternate version would replace that baseball with a tethered softball.

For greater durability and resistance to unintentional damage, the new device at FIG. 1B added several, separately patentable improvements to the prior lighted line (element 9 in FIG. 1A). More particularly, applicants have included a deflector tube 120 at a forward most end of its LED cable system, generally 121. Then, to better protect the string of LED lights, generally 122 comprising cable system 121, this iteration of batting practice device has incorporated said lights in a more resistant casing or clear tubing 123 along most of the length of LED line 122. Lastly, this invention further modified the means for connecting V-line joinders to the bulk of cable system 121. Rather than affixing directly to LED cable 121 at an end closest to ball 108, this invention has its V-line connections joining to a new sliding ring 124 for traversing along tubing 123 with every batted ball swing connection.

In the version shown in the accompanying drawings, tubing 123 connects to the midpoints of frame 102 via a T-shaped joinder bar 125 with a distal end of cable 121 passing through netting 110 before bending upwardly at section 127 for eventual connection to the swing computing means 150 of this invention.

Figure 2:
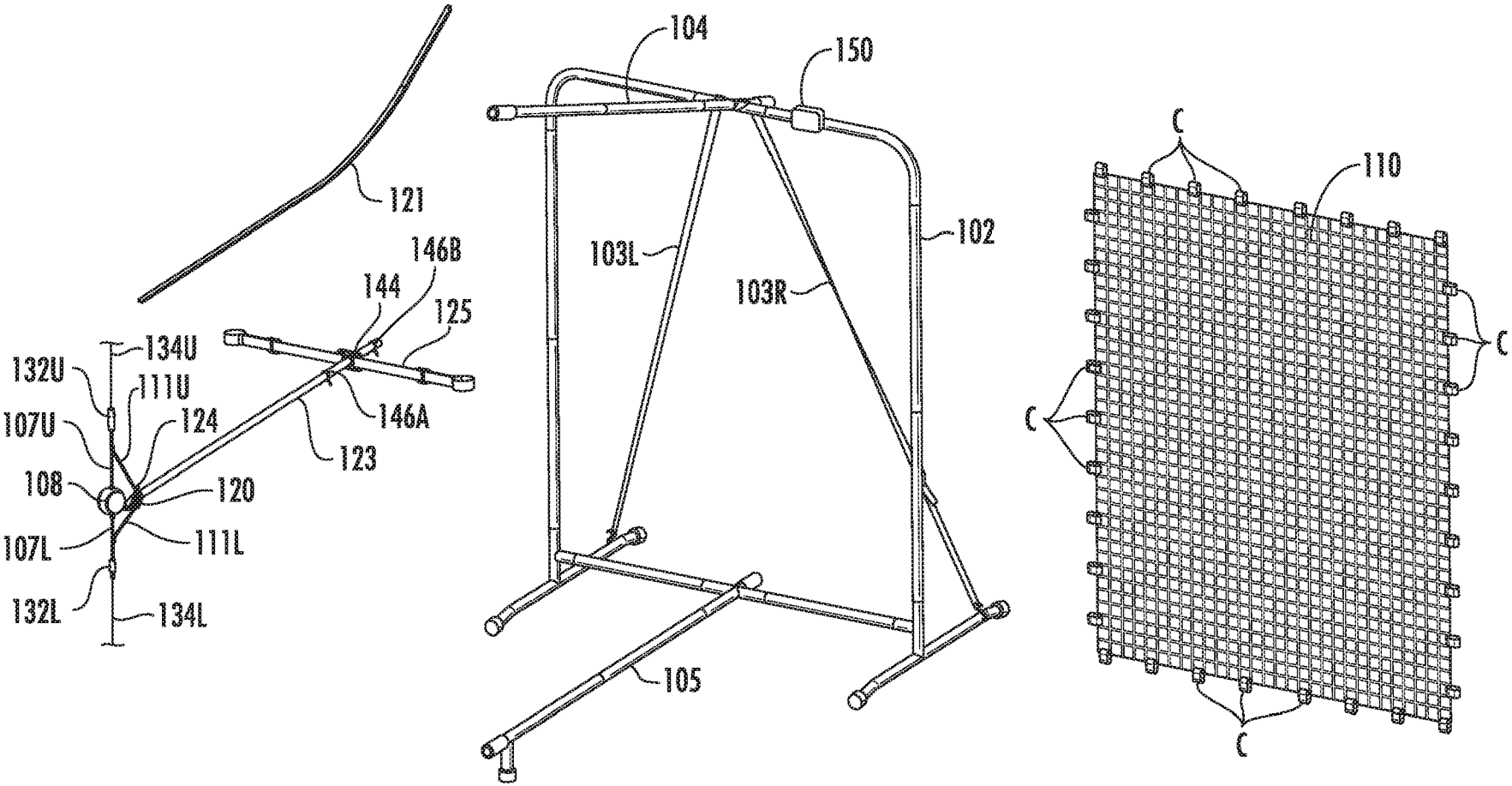
FIG. 2 is an exploded sectional perspective of the various component parts making up one embodiment of swing training device per this invention; view focusing on the back end of the LED cable system wrap as it passes through netting.

FIG. 2 shows the various components of this latest invention in an exploded, pre-assembly manner. More particularly, there is frame 102 with its upper arm 104 and lower arm 105 with an added set of stabilizing straps 103L, 103R visibly shown for better stabilizing a frame and netting embodiment to a model with lower frame legs. The more portable version of device, shown in FIG. 1B includes a plurality of lower frame wheels W. Netting 110 affixes about the perimeter of frame 102 using a plurality of netting straps or clips C.

Figure 3:
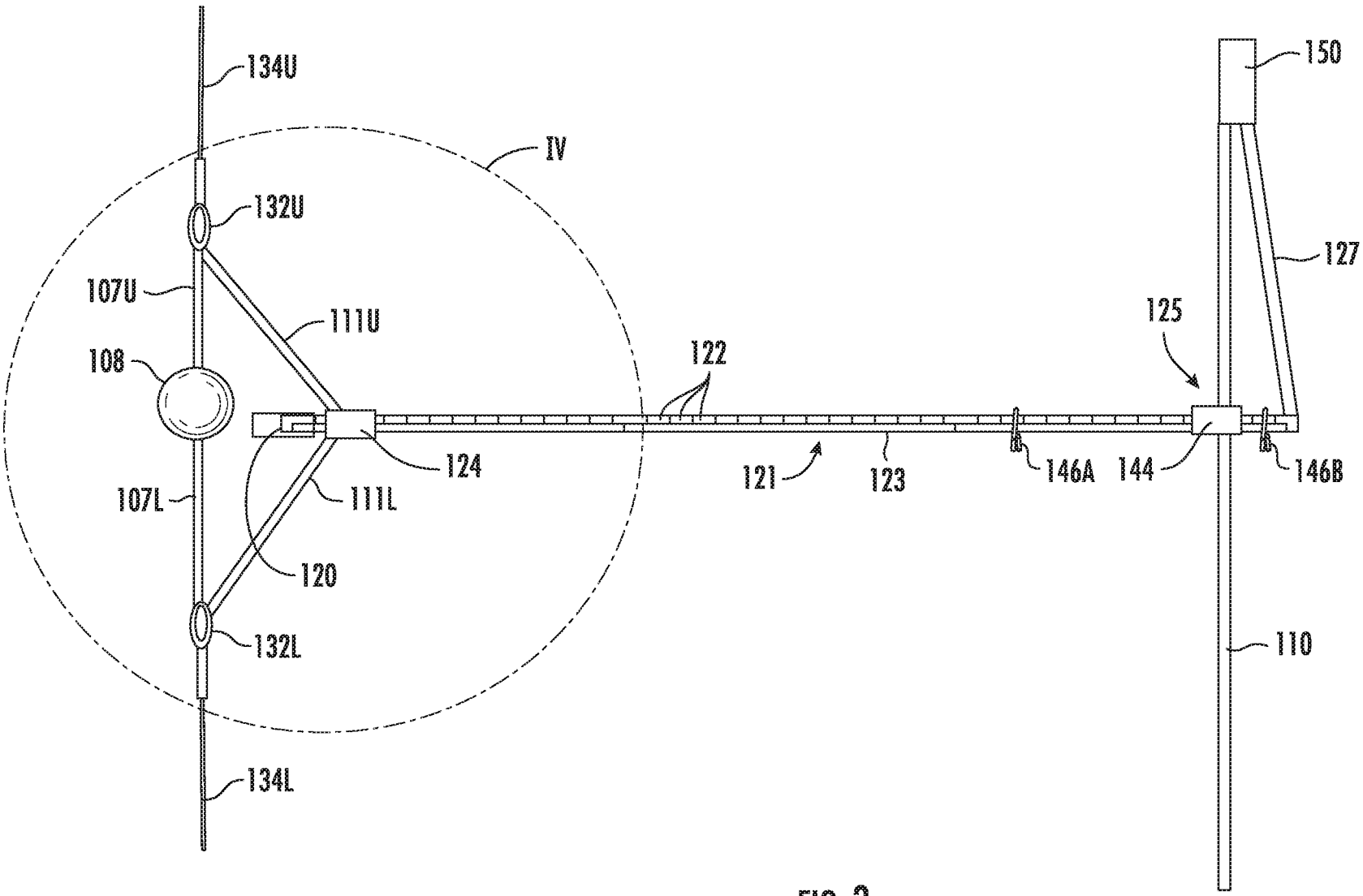
FIG. 3 is a side perspective view focusing on the LED cable system and practice ball connection thereto.
Figures 4, 5:
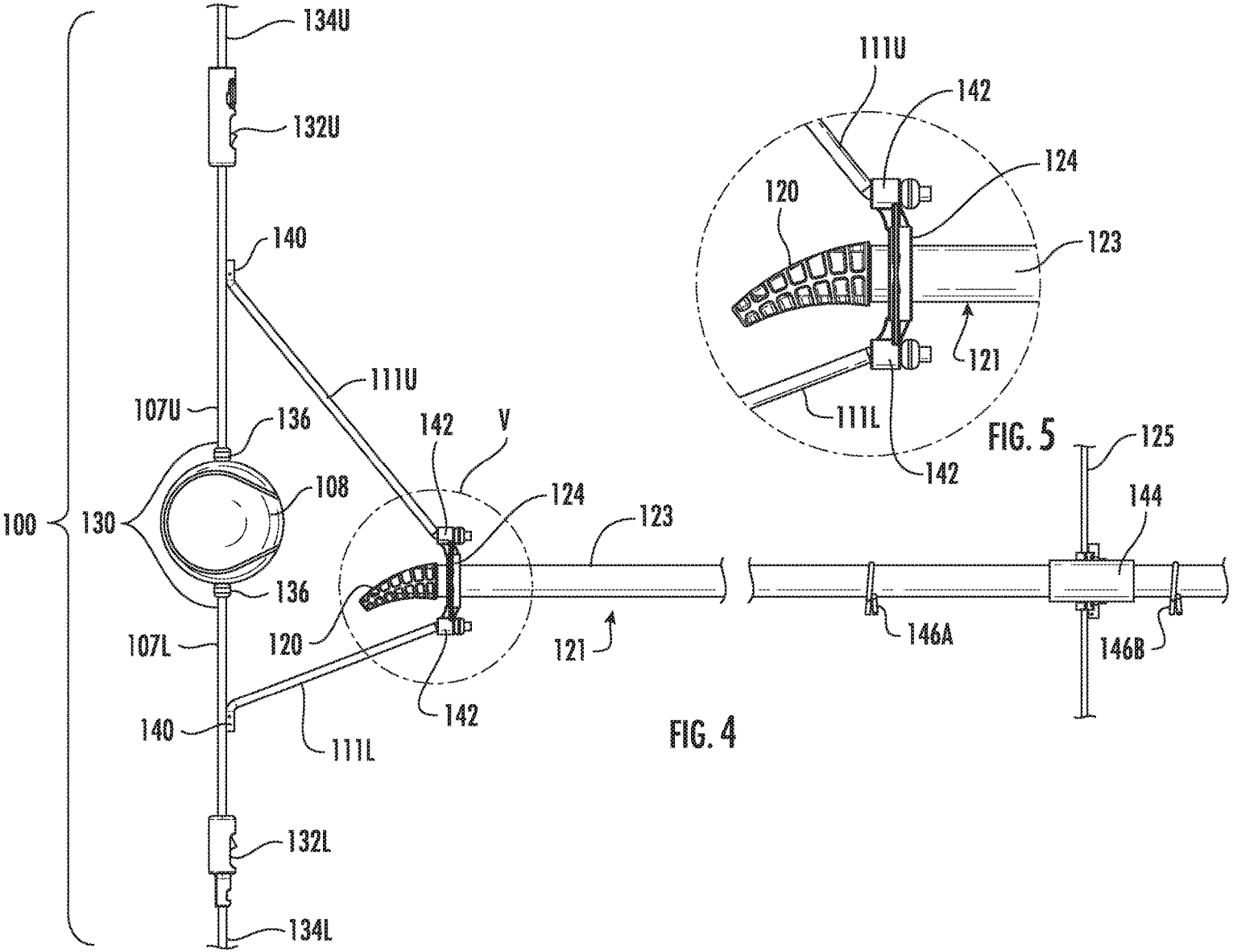
FIG. 4 is an enlarged side view focusing on the circled area IV of FIG. 3.
FIG. 5 is an enlarged side view of circled area V of FIG. 4.

FIGS. 3 through 5 focus on these several main improvements in greater detail. At FIG. 4, the assembly as a whole, item 100, depicts a baseball 108 coupled to a non-elastic, nylon rope 130 actually comprising sub-components 107U and L. (In an alternate embodiment, not shown, ONE section of nylon rope can be made to pass into and through the vertical diameter of a practice ball as described further herein.) The non-elastic "ball ropes" connect at their respective outer (i.e., away from the ball) ends via connectors 132U and L. They, in turn, continue upward via elastic stretch cord 134U to the frame's upper arm 104, and downward via elastic cord 134L to the lower arm 105 of frame 102. Ball 108 is physically anchored in place by knots 136 (only the upper knot is visible in FIG. 1B) such that the ball 108 is vertically held slightly above deflector tube 120.

Ball 108 and nylon rope 130 (or sub-sections 107U and L) also connect to the LED cable 121 with diagonal sections of rope 111U and L coupled at their forward most end to vertical rope 130 via knots 140, and at their respective rearward ends to a bolt 142 or other connector type on sliding ring 124. That sliding (or "slidable") ring 124 should have a diameter just slightly greater than the outer diameter of the LED cable system 121 passing there through.

In one alternate configuration (not shown), the non-elastic cord component may be threaded through a central hole drilled into a ball rather than connecting to both top and bottom of said ball. Or, balls may be made with a stiff central axis support (like a steel rod extending across the ball diameter, from top-to-bottom), said axis support including clips or other fastening means for joining to non-elastic ropes 107U and L that are, in turn, connected to their respective bungee-like lines 134U and L.

Deflector tube 120 is preferably made of a durable, yet soft flexible nylon, PVC tube, rubber tip or other similar material to serve as means for deflecting/cushioning the bat (or tethered ball) from making potentially damaging contact with the front end of LED cable 121 during swing executions, i.e., as ball 108 gets repeatedly hit and the user's bat travels through its arc/practice swing. This short section of tubing would be the "shock absorber" purposefully added to this invention's improved tube lighting system.

Nearer the proximal end of LED cable 121, there is a second sliding ring 144 that joins to the sides of the T-shaped joinder bar 125 between the two vertical sides to frame 102. Alternately, T-bar 125 can be supplemented with or fully replaced by one or more straps for anchoring LED cable 121 to the frame proper. Ideally, LED cable 121 slides through this rearwardly placed, sliding ring 144 to provide more strain relief and/or cushion to the overall LED assembly if it were hit by a swinging bat. Two clamps, 146A and B, physically restrict the amount that LED cable 121 may move about or slide through rear sliding ring 144.

Figure 6:
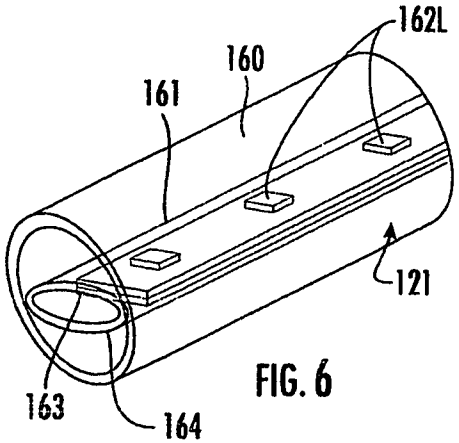
FIG. 6 is a sectional perspective view showing one end of LED cable system with a representative O-ring positioned thereon.

Now continuing with the LED cable 121 at FIG. 6, one preferred embodiment comprises an outer protective sheath 160 that may be semi-rigid to rigid. One such example of outer sheath 160 comprises polycarbonate tubing that is circular-shaped, in cross-section. Protective outer sheath 160 should be transparent, either clear or colored-though still see through. It protects the inner components of LED cable 121, namely a flexible section of WS2812 or other similar light strip 161 containing about fifty or more LED lights 162L electrically joined on the strip such that the lighting sequence and timing of these lights are controlled by a control box/computing device 150.

The WS2812 light strip 161 extends from the rear side of ball 108, horizontally through the polycarbonate tubing 123, to and then through the back of netting 110 before bending vertically upwards at section 127, along the backside of netting 110 and into control box 150. As best seen in FIG. 6, the WS2812 strip 161 can be protected by a backing of spring steel or nylon material 163 before the latter gets heat shrunk to the WS2812 strip 161 using a transparent, heat shrink tube 164.

Figure 7A:
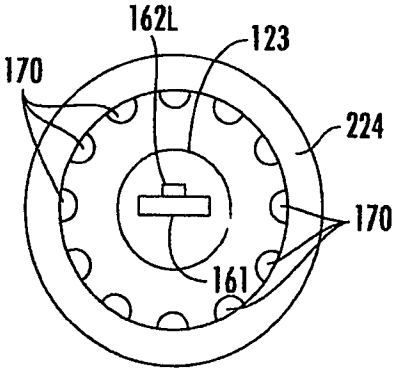
FIG. 7A is a front plan view of a first alternative O-ring, LED cable arrangement using a plurality of ball bearings.
Figure 7B:
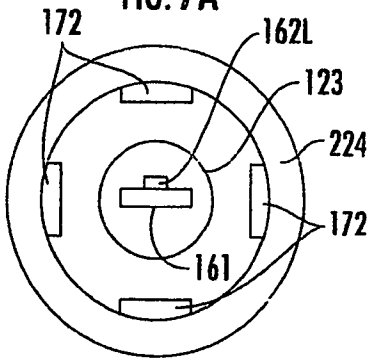
FIG. 7B is a front plan view of a second alternative O-ring, LED cable arrangement using a plurality of rollers.

FIGS. 7A and B show alternatives to a round O-ring slider for the present invention. Particularly therein, each of the alternate sliding rings about: LED cable tubing 123, WS2812 strip 161 therein and plurality of LED lights 162L thereon, has supplemental sliding assists. The O-ring 224 of FIG. 7A has a plurality of ball bearings 170 about its inner circumference, for contacting with and sliding along cable tubing 123. In the other variation shown at FIG. 7B, the slide assists are a plurality of spaced apart rollers 172.

Now describing methods of using this new and improved device/system, the computing device 150 initializes a timed sequence of LED lights 162L that advance along the transparent tubing 123 toward the ball 108 for serving as a cue for the device user/batter to initiate a swing that will allow his/her bat to make contact with the ball 108 when the last LED light 162L illuminates. That bat contact with the ball 108 will propel it toward the netting 110 at least partially along transparent tubing 123 by horizontally sliding there along facilitated by ring 124. The stretch cords 107U, 107L attached to ball 108 control the forward movement along tubing 123. The amount of stretching is determined by the energy of the impact (of bat to ball). Once that force of energy is expended, the ball 108 quickly rebounds back to its starting position. The entire system now better protects the LED components while providing a smooth hitting experience for a batter as designed for ball-and-bungee cord system.

As previously claimed, the use of motion and/or sound sensors can detect the batter's contact and determine the timeliness of each practice swing. A current model uses a vibration sensor located on the rear end of the tube, on the back side of the netting. That sensor is wired to the control box for picking up bat-to-ball contact. It should be understood, however, that numerous other motion and/or sound sensors could be located elsewhere, such as on the frame, the tube, various cords, even the ball itself. And these sensors may include accelerometers to not only detect contact but also measure ball motion after being hit, i.e., exit velocity and direction.

Figure 8:
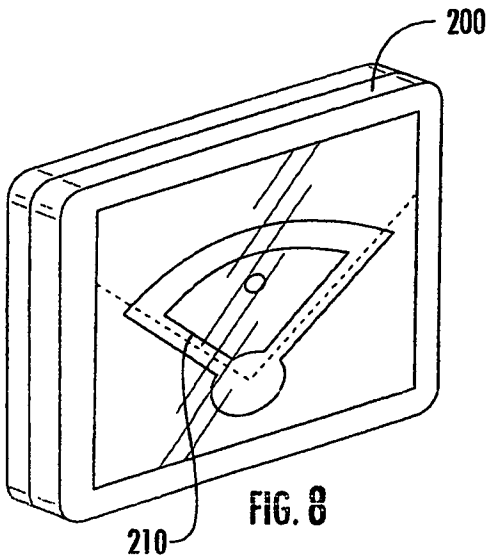
FIG. 8 is a front plan view of one embodiment of ball contacting monitor/display for use with this invention.

To better display how well the batter has contacted the ball, one preferred display means (item 200 in FIG. 8) can take the swing and contact data from control box/computing device 150 and quickly translate to show approximately where the ball from a given swing would land on a representative virtual baseball diamond playing field 210.

An LED cable operatively couples to the practice, tethered ball assembly with its distal end passing through device netting when fully assembled. In this latest version, the LED cable is now encased in a rigid (or semi-rigid) liner that is preferably clear though in alternative embodiments, the tubing may be slightly tinted or colored though still transparent.

One preferred embodiment of LED cable can be made from several components layered in the following particular order:

1. An LED light cable that includes:
   a. An LED assembly with
      i. a flexible LED (WS2812 style—addressable) strip approximately 1600 mm long and comprised of 50 LED lights as one embodiment;
      ii. 300 mm long, 3-conductor, ribbon cable connected to end A of the aforementioned 1600 mm LED strip wherein:
         1. conductors shall be stranded copper
         2. gage shall be 30 AWG to 22 AWG as required for electrical quick connector contacts and LED strip soldering;
      iii. an electrical quick connector on an end of the ribbon cable, wherein:
         1. connector housing shall be the XHP-3 with suitable conductor contacts therein to be compatible with a JST-S3B-XH-A receptacle, both from JST Sales America, Inc.
   b. a 1600 mm long, steel spring strip similar to the metal spring strips in a retractable tape measure;
   c. a 1600 mm long, insulator strip that may be:
      i. a fabricated plastic insulator strip, or
      ii. the pressure-sensitive adhesive and coated paper cover normally found on self-adhesive LED strips, but NOT
      iii. the pressure sensitive adhesive without its paper cover;
   d. a clear, heat shrink tube (length as required for complete coverage after heat shrinking) that covers: the ribbon cable, the LED light assembly, the insulator strip, and the steel spring strip.

Note, the full assembly of "d" is protected inside a semi rigid/transparent polycarbonate-style tube wherein the proximal end is slidably connected to the ball assembly through an O-ring and the distal end is slidably connected to an O-ring connected to the vertical frame serving as a backstop.

Further Requirements

A. the LED assembly should not protrude past the end of the heat shrink tube.

B. the heat shrink tube should not extend past the end of the LED Assembly by more than 10 mm.

C. if possible, the heat shrink tube should cover a portion of the electrical quick connector. If a second, opaque heat shrink tube of larger diameter is required to cover the electrical quick connector, the finished length should not extend over any LED lights.

D. the steel spring strip should not cover the LED lights.

For sliding along the aforementioned LED cable, there is provided a third inventive component of this disclosure namely the use of a sliding O-ring having top and bottom connectors to the bungee cord that holds the practice batting ball (baseball OR softball). The O-ring is meant to move laterally along the polycarbonate tube that houses the LED cable with each successful swing contact with the practice ball.

Additional developments may include:

1. adding more motion sensors to calculate batted ball exit velocities AND the direction that the practice ball was hit, and would likewise travel on a displayed baseball field;
2. advanced data analysis for individual players and teams; and/or
3. the ability to play through a WEB interface where players could play each other remotely.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

What is claimed is:

1. An improved swing training device that comprises:

a substantially rigid frame;

an upper, substantially horizontal member extending outwardly from the rigid frame and a lower, substantially horizontal member extending outwardly from the rigid frame;

a baseball or softball for repeatedly hitting to practice a bat swing;

a transparent tube through which a plurality of LED lights extend for electronically sequencing, from rear-to-front of the transparent tube, to simulate a pitched ball;

an upper elastic line that extends substantially vertically downward from the upper, substantially horizontal rigid frame member and connects at its lower end to a non-elastic, upper ball line joined to an upper region of the baseball or softball;

a lower elastic line that extends substantially vertically upward from the lower, substantially horizontal rigid frame member and connects at its upper end to a non-elastic, lower ball line joined to a lower region of the baseball or softball;

a non-elastic, upper connector line that affixes to the non-elastic, upper ball line at a first end of the upper connector line and to a slidable first collar at a second end of the upper connector line, said slidable first collar adapted for sliding back and forth in a substantially horizontal direction along a forward end, nearest the baseball or softball, of the transparent tube;

a non-elastic, lower connector line that affixes to the non-elastic, lower ball line line at a first end of the lower connector line and to the slidable first collar at its a second end of the lower connector line, said non-elastic upper connector line and said non-elastic lower connector line forming a non-elastic, V-shaped connection between the baseball or softball and the transparent tube; and a control box for varying the speeds at which the plurality of LED lights electronically sequence from rear to front in the transparent tube.

2. The improved swing training device of claim 1, which further includes: a force-absorbing tip component at a forward most end of the transparent tube nearest the baseball or softball.

3. The improved swing training device of claim 2 wherein the tip component is made from nylon, PVC piping or rubber.

4. The improved swing training device of claim 1 wherein the transparent tube is made from a clear polymer material.

5. The improved swing training device of claim 1 wherein the substantially rigid frame further includes one or more frame-stabilizing straps.

6. The improved swing training device of claim 1, which further includes a plurality of sensors for measuring batter reaction swing timing relative to the electronic sequencing of the plurality of LED lights in the transparent tube.

7. In a swing training device a substantially rigid frame; an upper, substantially horizontal, rigid frame member extending outwardly from a top of the rigid frame and a lower, substantially horizontal, rigid frame member extending outwardly from a bottom of the rigid frame; a baseball or softball for repeatedly hitting to practice a bat swing; an upper elastic line that extends substantially vertically downward from the upper, substantially horizontal, rigid frame member and connects at its lower end to a non-elastic, upper ball line joined to an upper region of the baseball or softball; a lower elastic line that extends substantially vertically upward from the lower, substantially horizontal, rigid frame member and connects at its upper end to a non-elastic, lower ball line joined to a lower region of the baseball or softball; a non-elastic, upper connector line that affixes at an of the upper connector line to the non-elastic, upper ball line; a non-elastic, lower connector line that affixes at a of the lower connector line to the non-elastic, lower ball line, said non-elastic, upper connector line and said non-elastic, lower connector line forming a non-elastic V-shaped connection between the baseball or softball and a front end of a strip having a plurality of LED lights that electronically sequence for simulating a pitched ball; and a control box for varying the speeds at which the plurality of LED lights electronically sequence from rear to front along the strip, the improvement which comprises:

(a) the strip with the plurality of LED lights being encased in a rigid or semi-rigid, transparent tube made from a damage resistant polymer; and (b) a rear end of said non-elastic, upper connector line and a rear end of said non-elastic, lower connector line both being connected to an O-ring that slidably engages along the transparent tube when a user's bat contacts with the baseball or softball.

8. The improvement of claim 7 wherein the transparent tube is clear.

9. The improvement of claim 7 wherein the transparent tube consists essentially of a polycarbonate and has a circular cross-section.

10. The improvement of claim 7 wherein the substantially rigid frame further includes one or more frame-stabilizing straps.

11. The improvement of claim 7, which further comprises a force-absorbing tip component positioned at a forward most end of the transparent tube nearest the baseball or softball of said non-elastic, lower connector line to an O-ring that slidably engages along the transparent tube when a user's bat contacts with the regulation size baseball or softball.

12. The improvement of claim 7 wherein the O-ring is made from a lubricating polymer material.

13. The improvement of claim 7 wherein the O-ring contains a plurality of integral ball bearings or rollers about its inner circumference.

* * * * *